US005486022A

United States Patent [19]

Crane

[11] Patent Number: 5,486,022

[45] Date of Patent: Jan. 23, 1996

[54] SECURITY THREADS HAVING AT LEAST TWO SECURITY DETECTION FEATURES AND SECURITY PAPERS EMPLOYING SAME

[75] Inventor: Timothy T. Crane, Windsor, Mass.

[73] Assignee: Crane & Co., Inc., Dalton, Mass.

[21] Appl. No.: 222,657

[22] Filed: Apr. 4, 1994

[51] Int. Cl.[6] ..... B42D 15/00

[52] U.S. Cl. ..... 283/83; 283/70; 283/91; 283/901; 428/916

[58] Field of Search ..... 283/83, 70, 91, 283/901

[56] References Cited

U.S. PATENT DOCUMENTS

| | | | |
|---|---|---|---|
| 4,183,989 | 1/1980 | Tooth | 428/195 |
| 4,534,398 | 8/1985 | Crane | 162/103 |
| 4,869,778 | 9/1989 | Cote | 156/635 |
| 4,943,093 | 7/1990 | Melling et al. | 283/83 |
| 5,354,099 | 10/1994 | Kaule et al. | 283/85 |

FOREIGN PATENT DOCUMENTS

| | | |
|---|---|---|
| 0310707 | 4/1989 | European Pat. Off. . |
| 0279880 | 9/1993 | European Pat. Off. . |
| 9211142 | 7/1992 | WIPO . |

*Primary Examiner*—Patrick J. Ryan
*Assistant Examiner*—Kam F. Lee
*Attorney, Agent, or Firm*—Mary R. Bonzagni; Holland & Associates

[57] ABSTRACT

A visually verifiable and machine-readable security thread having at least two security detection means located thereon, where a first security detection means comprises a machine-readable repeating pattern and where a second security detection means comprises visually verifiable metal-formed indicia. Such security threads are suitable for use with security documents, such as banknotes and the like, labels and any other documents or means of identification used for purposes which make the verification of the authenticity of each specimen desirable at least once in its lifetime.

10 Claims, 1 Drawing Sheet

SECURITY THREADS HAVING AT LEAST TWO SECURITY DETECTION FEATURES AND SECURITY PAPERS EMPLOYING SAME

FIELD OF THE INVENTION

The present invention relates generally to machine readable and visually verifiable security strips or threads suitable for at least partial incorporation in and/or for mounting on security documents or means of identification, such as labels. In addition, the present invention relates to security papers employing such a thread(s), processes for making such security papers and to methods for their verification.

BACKGROUND OF THE INVENTION

It is known that security papers may be rendered less susceptible to counterfeiting by including threads at least partially within the body of the papers. The threads are typically introduced during the manufacture of such security papers and generally take the form of a continuous thread or ribbon of polyester, regenerated cellulose, polyvinyl chloride, or other plastics film coated with a layer of metal and/or magnetic material. In particular, the thread may take the form of: a fully metallized thread, which is presently in wide use in security documents around the world; partially demetallized threads that display positive image metal characters or indicia, currently used in United States Currency; or partially demetallized threads that display negative image or clear characters or indicia that are defined by metal boundaries, currently used in currencies such as the German Deutsche Mark. Security papers employing such partially demetallized threads are described in European Patent No. 0 279 880 while security papers employing partially demetallized threads displaying clear characters are described in U.S. Pat. No. 4,943,093. In addition to the above, the thread may take the form of a thread coated with a coded pattern of magnetic material and with a layer of either a luminescent, an x-ray absorbent or a non-magnetic metal material, as described in U.S. Pat. No. 4,183,989.

Threaded security papers are routinely examined for authenticity by members of the public and verified for authenticity by a variety of devices that include capacitive thread detectors, microwave detectors, eddy current detectors, x-ray detectors (e.g., a scintillation counter) and detectors that depend upon intrinsic magnetic properties such as permeability, retentivity, hysterisis loss and coercivity.

Fully metallized threads, either fully or partially embedded in security papers, are relatively easy to detect by capacitive thread detectors. However, these detectors merely detect the presence or absence of such threads and are easily fooled by lines of conductive material (i.e. pencil lines) on the surface of the document. Moreover, such threads, even when fully embedded in a security paper are visible under reflective illumination. Therefore, a pencil line drawn on the surface of a counterfeit note could easily deceive members of the public into thinking that the document is authentic.

Partially demetallized threads, such as those used in United States Currency, employ a security feature (i.e. metal characters) that can be visually detected only under transmitted illumination and that can be machine detected. However, commercially available thread detectors merely detect the presence or absence of the conductive features or characters on these threads. Due to the small size of the characters, machine reading (i.e., denomination determination) of characters or indicia is extremely difficult. Optical character recognition or other imaging based schemes would have to be employed to ascertain such detailed information.

Partially demetallized threads, such as those used in the German Deutsche Mark, employ a security feature (i.e., clear characters defined by metal boundaries) that can also be visually and machine detected. Such threads have a continuous metal path that extends the entire length of the thread which reportedly makes these threads easier to detect by commercially available thread detectors. However, only the presence or absence of these threads are detected by such detectors. Moreover, machine reading such threads would be even more difficult than machine reading the metal characters employed on the United States Currency threads where the detectable metal material merely forms the boundary of the indicia.

Threads coated with a layer of magnetic material and with either a luminescent, an x-ray absorbent or a non-magnetic metal material, where the magnetic material is possibly applied in a coding pattern (e.g., magnetic coating applied discontinuously onto a thread with the discontinuities detected with a field detecting device or two different magnetic materials provided in alternating bands along the thread), as described in U.S. Pat. No. 4,183,989, are machine readable but do not offer a public security feature, such as text. Moreover, relying upon the field produced by a certain magnitude or configuration of magnetic materials is problematic in that such coded variations are subject to obliteration by intentional or accidental demagnetization subsequent to the original magnetization. In addition, although magnetic metal, such as iron oxide coatings, can be applied discontinuously onto a thread, in a bar code like sequence or in varying depths of coating, to accomplish a machine-readable feature, such application processes require specialty screen printing equipment to apply the iron oxide slurry in defined bars. Moreover, magnetic field array detectors are required to resolve the coded sequence. These array detectors are expensive to manufacture and are particularly problematic for reading threads when banknotes or other documents are processed narrow-edge versus wide-edge where the number of sites on the array that are processed for the wide-edge feed condition are reduced.

It is therefore an object of the present invention to provide a security thread that offers a machine-readable security feature that has repeatable portions that extend the length of the thread, that facilitates high speed machine reading and that is not subject to obliteration.

It is a further object of the present invention to provide a security thread that, in addition to offering a machine-readable security feature, offers a public security feature.

It is yet a further object of the present invention to provide a security thread suitable for use with security documents, labels and any other document or means of identification used for purposes which make the verification of the authenticity of each specimen desirable at least once in its lifetime.

SUMMARY OF THE INVENTION

The present invention therefore provides a security thread, suitable for at least partial incorporation in and/or for mounting on a security document or means of identification, such as a label. The present inventive security thread comprises a plastic thread or ribbon having at least two security detection means located thereon, where a first security detection means comprises a repeating pattern and where a second security detection means comprises metal-formed indicia. The pattern of the first security detection means comprises at least one metal region and at least one electrically isolating or nonconductive region, where such regions extend across the entire width of the plastic thread and are in an alternating sequence.

The present invention further provides a security paper having a first surface and having a security thread, as defined hereinabove, at least partially embedded therein and/or mounted on the first surface.

The present invention also provides a process for making a security paper having a first surface, which process comprises at least partially embedding a security thread, as defined hereinabove, in the security paper and/or mounting the security thread on the first surface of the security paper.

The present invention additionally provides a method of verifying the authenticity and reading the coded information of a security paper containing a security thread, as defined hereinabove, which method comprises: identifying the repeating pattern on the thread by a machine; and visually detecting, in transmitted illumination, the metal-formed indicia on the thread.

The foregoing and other features and advantages of the present invention will become more apparent from the following description and accompanying drawings.

DESCRIPTION OF THE PREFERRED EMBODIMENT

Although the present inventive thread is described hereinbelow in association with security papers, such as banknotes and the like, the invention is not so limited. The inventive thread can be utilized with any document or means of identification for authentication purposes.

Figure 1:
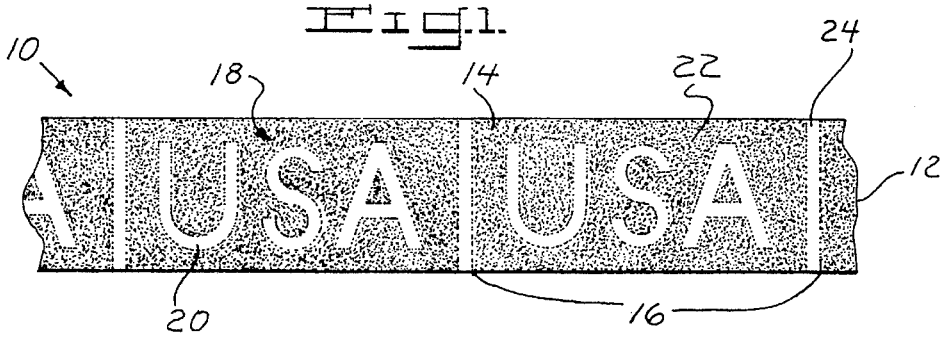
FIGS. 1 to 4 are plan views of various preferred embodiments of the present inventive security thread.
Figure 2:
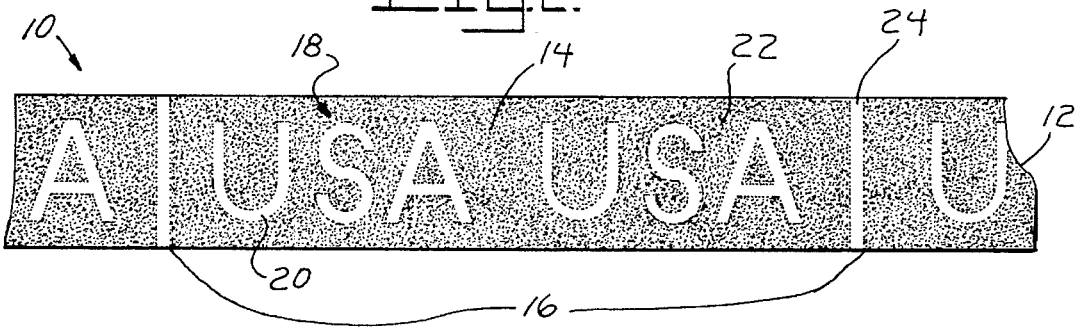
Figure 3:
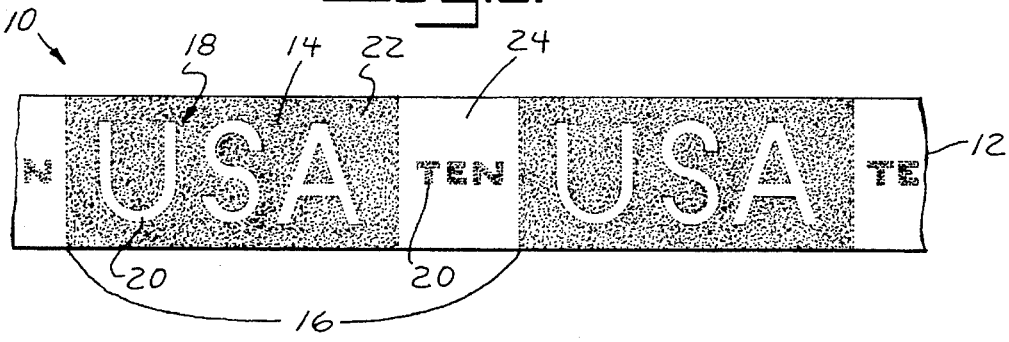
Figure 4:
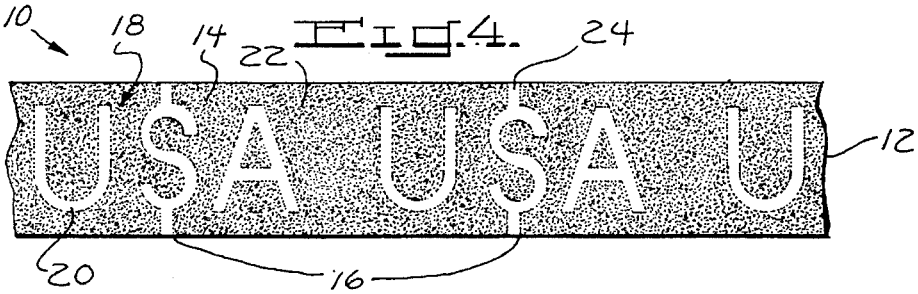

Referring to the drawings in detail, a preferred embodiment of the security thread of the present invention is shown and generally designated by the reference numeral 10. The inventive thread 10 basically comprises a plastic thread or ribbon 12 having at least two security detection means located thereon, where a first security detection means 14 comprises a repeating pattern 16 and where a second security detection means 18 comprises metal-formed indicia 20. The pattern 16 of the first security detection means 14 comprises at least one metal region 22 and at least one electrically isolating or nonconductive region 24, where such regions extend across the entire width of the plastic thread 12 and are in an alternating sequence. In the preferred embodiment shown in FIG. 1, the repeating pattern 16 comprises one metal region 22 and one non-conductive region 24 with both regions adopting a rectangular configuration. The metal-formed indicia 20 are located only in the metal region 22 of the inventive thread 10 shown in FIG. 1. In the preferred embodiment displayed in FIG. 2, the repeating pattern 16 comprises one metal region 22 that has an increased total area of coverage on the thread 10 so as to accommodate additional metal-formed indicia 20. In FIG. 3, which displays yet another embodiment of the present invention, the metal-formed indicia 20 are located in both the metal region 22, as clear characters, and in the electrically isolating or non-conductive region 24, as metal characters. In FIG. 4, the electrically isolating region 24 adopts the configuration of a dollar sign and the metal-formed indicia 20 are located only in the metal region 22.

The plastic thread or ribbon 12 of the present invention may be manufactured from any clear or translucent, nonconductive material. Such materials include polyester, regenerated cellulose, polyvinyl chloride, and other plastic film, with the preferred material being polyester. Such films remain intact during the papermaking process and preferably have a width ranging from about 0.8 millimeters (mm) to about 3.0 mm. Moreover, such films, being non-conductive, do not interfere with the signal seen by an authenticity testing device.

The first security detection means 14 of the present invention comprises a repeating pattern 16 made up of at least one metal region 22 and at least one non-conductive or electrically isolating region 24. The metal and non-conductive regions 22, 24 may adopt any shape or configuration and extend across the entire width of the plastic thread 12. Moreover, the regions 22, 24 are arranged in an alternating sequence in each pattern 16 of the first security detection means 14 and across the length of the plastic thread 12. It is contemplated that any one type of security document or label would employ threads displaying identical repeating patterns. Accordingly, each type of document or label would generate identical detection signatures when processed under the same conditions through an appropriate authenticity testing device.

The second security detection means 18 or public security feature comprises metal-formed indicia 20, such as metal characters or clear characters defined by metal boundaries. These metal-formed indicia 20 do not extend across the entire width of the plastic thread 12 and may be located, in the form of clear characters, within the metal region 22 of the first security detection means 14. These indicia may also be located, in the form of metal characters, within the nonconductive or electrically isolating region 24, provided, however, that they are small enough so as not to create a conductive path that would interfere with the spikes or evenness of spacing between the spikes of the curves generated by the thread when processed by an authenticity testing device. In a preferred embodiment, where the inventive thread 10 is totally embedded in a security paper, these indicia 20 constitute a term or phrase that is not discernable in reflective illumination, but which becomes legible in transmitted illumination to the viewing public.

The first and second security detection means 14, 18 can be advantageously formed at the same time by depositing metal on the plastic thread or ribbon 12 by any one of a number of methods including, but not limited to, methods involving selective metallization by electrodeposition, directly hot stamping onto the thread or using a mask or template in a vacuum metallizer and methods involving metallization and selective demetallization by chemical etching, laser etching and the like. It is preferred that the first and second security detection means 14, 18 be formed on the thread by a resist and etch technique as described in U.S. Pat. 4,869,778. It is also preferred that the metal deposited on the thread 12 have a thickness of from about 100 to about 400 angstroms (Å) and more preferably have a thickness of about 100 to about 300Å.

The metal used to form the first and second security detection means 14, 18 of the present invention can be any metal that, upon deposition on the thread 12 and embeddment of the metallized thread in a security paper, produces little or no manifestation on the surface of the paper under reflective illumination. Such metals include aluminum, nickel, and silver, with the preferred metal being aluminum.

The present inventive thread may include additional layers or coatings that serve to enhance the second security detection means 18 or public security feature of the present invention, provided however that such coatings are not opaque and do not interfere with the signal seen by an authenticity testing device. Such coatings include fluorescent coatings made up of eosin, fluorescein, fluorspar, fuchsin, sulphate of quinine, calcium sulphide, Neodymium salicylate, Samarium gluconate, Yttrium salicylate and the like.

The security thread 10 according to the present invention may be at least partially incorporated in security papers during manufacture by techniques commonly employed in the paper-making industry. For example, the inventive thread 10 may be pressed within wet paper fibers while the fibers are unconsolidated and pliable, as taught by U.S. Pat. No. 4,534,398, resulting in the thread being totally embedded in the resulting paper. The thread 10 may also be fed into a cylinder mold papermaking machine, cylinder vat machine, or similar machine of known type, resulting in partial embeddment of the thread within the body of the finished paper (i.e., windowed paper). In addition to the above, the security thread 10 of the present invention may be mounted on the surface of security documents either during or post manufacture. Mounting of the thread 10 may be achieved by any number of known techniques including: applying a pressure-sensitive adhesive to a surface of the thread 10 and pressing the thread 10 to the surface of the document; and applying a heat activated adhesive to a surface of the thread 10 and applying the thread 10, using thermal transfer techniques, to the surface of the document.

The detection and reading of the coded information or repeating pattern 16 of the first security detection means 14, in accordance with the method of the present invention, may be carried out, for example, by detectors that depend upon intrinsic metal properties such as capacitance and microwave resonance. For example, the detection and reading of the repeating pattern 16 may be performed by: detecting and recording the changes in capacitance (i.e., detection signature) that occur when the subject thread embedded paper is passed over a metallic electrode; comparing the detection signature with detection signatures for known types of authentic documents; verifying the authenticity of the document; and, if authentic, reporting the type of authentic document having a matching detection signature. Such capacitance detectors are available from Authentication Technologies, Inc., 6670 Amador Plaza Road, Suite 204, Dublin, Calif. 94568. In employing such detection devices, it is preferred that each metal region 22 of the first security detection means 14 of the present inventive thread 10 be from about 5 mm to about 50 mm in length and more preferably be at least about 12.7 mm in length and that the metal-formed indicia 20, if present, occupy less than about 75 percent (75%) of the total area of each metal region 22. It is further preferred that the non-conductive or electrically isolating regions 24 be from about 0.1 mm to about 10 mm in length and that, if the metal-formed indicia 20 are present in the regions 24, that such indicia 20 do not create a conductive path and more preferably that the indicia 20 occupy less than about 75% of the total area of each such region 24. It is also preferred that the sensor of the capacitive detector be positioned within 10% of the length of the metal region 22 of the repeating pattern 16. For example, if the length of the metal region 22 is 12.7 mm, then the sensor should preferably be located about 1.3 mm from the thread 10.

The detection and reading of the first security detection means 14 may also be performed by: detecting and recording the changes in radiated power (i.e., detection signature) of microwaves from a source of known power (e.g., 1 to 20 gigahertz (Ghz)) through the paper; comparing and verifying the detection signature obtained; and then, if authentic, reporting the type of authentic document processed. Such microwave detectors are available from Authentication Technologies, Inc. It is preferred that each metal region 22 of the first security detection means 14 be at least about 5 mm in length and that the metal-formed indicia 20, if present, occupy less than about 95% of the total area of each metal region 22. It is further preferred that the electrically isolating regions 24 be from about 0.1 to about 10 mm in length and that if the metal-formed indicia 20 are present in these regions 24, that such indicia 20 occupy less than about 75% of the total area of each such region 24.

A principal advantage of security threads 10, according to this invention, is that the detection signatures obtained from the thread 10 are repeatable and have an evenness of spacing between the spikes of the curves generated in the detection process. As such, these curves or detection signatures are extremely valuable as a denominating structure. In addition, this higher level of machine verification is obtainable for documents employing such a thread 10, without additional manufacturing steps or complexity. Moreover, the first and second security detection means 14, 18 of the thread 10 have the appearance of a single graphics design, making it difficult for a counterfeiter to ascertain how many features are present.

It should be understood by those skilled in the art that obvious modifications can be made without departing from the spirit of the invention. Accordingly, reference should be made primarily to the accompanying claims, rather than the foregoing specification, to determine the scope of the invention.

Having thus described the invention, what is claimed is:

1. A security thread, suitable for at least partial incorporation in and for use on a security document or label which consists essentially of: a plastic thread having a width and having a layer located thereon wherein said layer comprises at least two security detection features, wherein a first security detection feature is a machine-readable feature which comprises a repeating pattern, wherein said pattern comprises at least one metal region and at least one electrically isolating region, in alternating sequence, wherein said metal region(s) and said electrically isolating region(s) extend across the entire width of said plastic thread, and wherein a second security detection feature comprises metal-formed indicia.

2. A security paper having a security thread at least partially embedded therein or mounted thereon, wherein said security thread consists essentially of: a plastic thread having a width and having a layer located thereon wherein said layer comprises at least two security detection features, wherein a first security detection feature is a machine-readable security feature which comprises a repeating pattern, wherein said pattern comprises at least one metal region and at least one electrically isolating region, in alternating sequence, wherein said metal region(s) and said electrically isolating region(s) extend across the entire width of said plastic thread, and wherein a second security detection feature comprises metal-formed indicia.

3. The security thread of claims 1 or 2 wherein said metal-formed indicia are clear characters defined by metal boundaries and are located on each metal region of each pattern of said first security detection feature.

4. The security thread of claim 3 wherein said metal-formed indicia occupy less than about 75% of the total area of each metal region.

5. The security thread of claims 1 or 2 wherein each metal region has a length ranging from about 5 to about 50 millimeters and wherein each electrically isolating region has a length ranging from about 0.1 to about 10 millimeters.

6. The security thread of claims 1 or 2 wherein said metal of said metal region and of said metal-formed indicia is aluminum.

7. The security thread of claims 1 or 2 wherein each electrically isolating region is a metal-free region.

8. The security thread of claims 1 or 2 wherein said metal-formed indicia are metal characters and are located on each electrically isolating region and wherein said indicia occupy less than about 75% of the total area of each such region.

9. The security thread of claims 1 or 2 wherein said metal-formed indicia are located on each metal region and on each electrically isolating region of each pattern of said first security detection feature.

10. A method of using an article to verify the authenticity and to read coded information of said article, wherein said article comprises a security paper containing a security thread comprising a plastic thread having a width and at least two security detection features located thereon, which method comprises: identifying, by a machine, a repeating pattern, wherein said pattern comprises at least one metal region and at least one electrically isolating region, in alternating sequence, wherein said metal region(s) and said electrically isolating region(s) extend across the entire width of said plastic thread, which repeating pattern is a first security detection feature; and visually detecting, in transmitted illumination, metal-formed indicia, which is a second security detection feature wherein said repeating pattern is identified by capacitance detector or by a microwave detector.

* * * * *